US005915576A

United States Patent [19]

Robinson

[11] Patent Number: 5,915,576

[45] Date of Patent: Jun. 29, 1999

[54] CHILD-RESISTANT SAFETY CLOSURE

[75] Inventor: Philip J. Robinson, Sylvania, Ohio

[73] Assignee: Owens-Illinois Closure Inc., Toledo, Ohio

[21] Appl. No.: 09/060,263

[22] Filed: Apr. 15, 1998

[51] Int. Cl.[6] ..... B65D 55/02

[52] U.S. Cl. ..... 215/216; 215/219; 215/334

[58] Field of Search ..... 215/216–219, 215/221–223, 330, 334, 295, 303

[56] References Cited

U.S. PATENT DOCUMENTS

| | | | |
|---|---|---|---|
| 2,752,060 | 6/1956 | Martin . | |
| 2,827,193 | 3/1958 | Martin . | |
| 3,376,991 | 4/1968 | Deaver . | |
| 3,770,153 | 11/1973 | Gach et al. . | |
| 3,854,622 | 12/1974 | McKirnan . | |
| 3,868,036 | 2/1975 | Wittwer | 215/219 X |
| 3,941,268 | 3/1976 | Owens et al. . | |
| 3,958,708 | 5/1976 | Le Brun, Jr. | 215/216 |
| 3,984,021 | 10/1976 | Uhlig . | |
| 4,004,704 | 1/1977 | Hilaire . | |
| 4,117,945 | 10/1978 | Mumford . | |
| 4,138,028 | 2/1979 | Price et al. . | |
| 4,172,533 | 10/1979 | Montgomery . | |
| 4,345,690 | 8/1982 | Hopley . | |
| 4,351,442 | 9/1982 | Summers | 215/216 |
| 4,383,618 | 5/1983 | Dougherty . | |
| 4,630,743 | 12/1986 | Wright | 215/216 |
| 5,186,369 | 2/1993 | Aguirrezabal . | |
| 5,238,130 | 8/1993 | Marques et al. . | |
| 5,671,853 | 9/1997 | Herr . | |
| 5,687,863 | 11/1997 | Kusz | 215/216 |

FOREIGN PATENT DOCUMENTS

| | | |
|---|---|---|
| 0410922A1 | 1/1991 | European Pat. Off. . |
| 2019527 | 6/1991 | Spain . |
| WO9004546 | 10/1988 | WIPO . |

*Primary Examiner*—Stephen Cronin
*Assistant Examiner*—Nathan Newhouse

[57] ABSTRACT

A double wall squeeze-and-turn child-resistant safety closure wherein skirt flexure stiffening web ribs are integrally molded into the closure so as to extend radially between the mutually facing wall surfaces of the skirts. The ribs are arranged in two sets of diametrically opposed web pairs generally angularly registered with an associated one of the pair of diametrically opposed outer wall squeeze zones. Each rib is also integrally joined to the closure base wall and protrudes therefrom axially of the closure a predetermined distance greater than the axial thickness of the peripheral region of the closure base wall that is joined to the ribs to thereby shift the outer skirt wall flexure swing point. Each pair of ribs is angularly spaced from one another on the closure base wall one on either side of and closely adjacent to a plane oriented at about 90 degrees to a plane intersecting the closure CR lugs to further localize the squeeze zone area. A pair of pressure pads are located one in each of the outer skirt wall squeeze zones and form a radially thickened portion that further stiffens and localizes the flexure mode of the outer skirt. The outer skirt wall preferably also has wall thickening portions radially inwardly protruding from the inner surface thereof and generally angularly registered with the pressure pads and web ribs to further enhance the outer skirt flexure mode and further localize effective squeeze activation area of the outer skirt wall.

22 Claims, 4 Drawing Sheets

CHILD-RESISTANT SAFETY CLOSURE

FIELD OF THE INVENTION

This invention relates to child-resistant safety closures, and more particularly to safety closures of the double wall squeeze-and-turn type.

BACKGROUND OF THE INVENTION

Heretofore, numerous versions of safety closures have been designed for the purpose of preventing children and other unknowledgeable persons from gaining access to dangerous household chemicals, medicaments and drugs, such as are conventionally packaged in containers for consumer use. One type of safety closure that has attained substantial commercial acceptance is that referred as a "squeeze-and-turn" type of safety closure. One type of such safety closures is referred to a "single sidewalled" closure, such as that disclosed in U.S. Pat. Nos. 3,376,991; 3,941,268 and 3,984,021. Such single sidewalled closures offer only limited versatility with respect to the style and design of the container with which they can be utilized. In other words, by virtue of the single sidewalled construction, both the internal threaded portion of the closure and the interlocking members, of necessity, are integral components of the same sidewall. Thus, in order to provide adequate flexibility to deform or distend the sidewall sufficiently to disengage it from the neck portion of the container, the sidewall must extend substantially beyond the threaded portion, which is rigidly engaged with the container neck portion. Also, to provide sufficient space to accommodate such deformation, the sidewall is necessarily flared outwardly from the neck of the container. Thus, the style and design of the closure is quite restricted.

The foregoing shortcomings of single sidewall squeeze-and-turn safety closures are overcome with so-called "double wall" squeeze-and-turn safety closures, such as those disclosed in U.S. Pat. Nos. 4,117,945 and 4,138,028, the disclosures of which are incorporated herein by reference in their entirety.

The safety closures of the aforementioned '945 and '028 patents feature the advantage of having a double sidewall construction in which an inner skirt sidewall is threadably engageable with the threaded neck portion of the container, i.e., the container "finish", and in which an outer skirt sidewall is resiliently deformable independently of the inner sidewall and also is provided on its interior surface with interlocking members designed to interlockingly engage the dispensing end of the container when the safety closure is in a fully closed and sealed position on the threaded neck portion of the container. The resiliently deformable or distensible construction of the outer sidewall is such that manual compression of the outer sidewall, at diametrically opposed locations angularly offset approximately 90 degrees from the diametrically opposite interlocking members, coupled with concurrent retrogressive rotation of the closure on the neck threads, will permit disengagement of the interlocking members and permit unthreading and removal of the closure from the container. Such a double wall closure permits placement of the closure interlocking member or members on the resiliently distensible outer sidewall of the double sidewall closure, thereby affording substantial advantageous variations in the overall length, style and configuration of the closure. In addition, the double wall type closure accommodates implementation of a variety of ancillary sealing features, if desired, such as those disclosed in the aforementioned '945 and '028 patents.

Such double wall squeeze-and-turn safety closures, like the prior single wall closures, have hitherto been constructed with sufficient wall thickness to maintain the "stiffness" necessary to pass child protocol regulations, such as inhibiting the possibility of accidental opening when the upper parts of the closure were bitten. This in turn has required more material, resulting in greater cost and weight of the double wall closure relative to a comparable single wall closure, in order to limit the amount of ovalization that can be created in the closure outer wall by application of a given amount of squeeze force in the outer skirt wall squeeze areas straddling the angular location of the locking lugs.

Another problem presented by the double wall squeeze-and-turn type safety closure versus the single wall type is the need to design sufficient radial clearance space between inner and outer skirt walls to enable vertical travel of the outer wall due to the outer skirt wall swing point, when squeeze-flexed, being at the inside top of the inner wall. This travel room requires a large radial clearance between the closure outer wall and container finish to enable sufficient outer wall deformation to create the degree of ovalization required for the lug unlocking action. The resultant large "radial standoff" of the outer wall from the closure finish thus increases the overall closure outside diameter, and also can create an additional problem of enabling children to gain purchase under the closure with their teeth, as well as creating a problem in terms of overall container design aesthetics.

OBJECT OF THE INVENTION

Accordingly, among the objects of the present invention are to provide an improved double wall squeeze-and-turn type child resistant safety closure, and a method of constructing same, that allow reduction of the overall weight of the closure through outer wall thickness reduction while maintaining the stiffness necessary to pass child protocol regulations, that effectively reduce and localize the force application area which de-activates through ovalization the safety closure child-resistant (CR) lug engagement to thereby provide a more child-resistant closure, that are less expensive to implement and hence reduce overall cost to both the closure manufacturers and their customers, that reduce the vertical travel of the outer wall when the same is squeezed in order to produce the CR lug disengagement and thus reduce the radial clearance required between the closure and container finish to thereby inhibit the ability of children to gain purchase under the closure with their teeth, that reduces the radial standoff aspect ratio of the closure to thereby improve overall closure/container design aesthetics, and that provide a closure of the foregoing character that is highly functional and manufacturable and yet will still pass current senior/child closure safety protocol testing requirements.

SUMMARY OF THE INVENTION

In general, and by way of summary description and not by way of limitation, the present invention accomplishes the foregoing as well as additional objects of the invention by providing a double wall squeeze-and-turn child-resistant safety closure wherein skirt flexure stiffening web means is integrally molded into the closure so as to extend radially between the mutually facing wall surfaces of the skirts. The web means are angularly offset and positioned generally between the outer skirt wall CR lugs, and are generally angularly registered with at least one of the outer wall squeeze zones. Preferably, the web means comprises a set of diametrically opposed web rib means wherein each rib means is generally angularly registered with an associated one of the outer wall squeeze zones, and angularly oriented at about 90 degrees with respect to the closure CR lugs. Preferably each web rib set is also integrally joined to the closure base wall and protrudes therefrom axially of the closure a predetermined distance greater than the axial thickness of the peripheral region of the closure base wall that is joined to the web rib sets.

In the disclosed embodiment, each set of the web means comprises a pair of ribs angularly spaced apart from one another on the closure base wall so as to be disposed closely adjacent to and on either side of a plane oriented at about 90 degrees to a plane intersecting the closure CR lugs. Additionally, the closure outer wall has a pair of pressure pads located one in each of the squeeze zones and forming a radially thickened portion of the outer skirt wall that further stiffens the flexure mode of the outer skirt. The outer wall preferably also has wall thickening portions radially inwardly protruding from the inner surface thereof and generally angularly registered with the pressure pads and web ribs to further enhance the outer skirt flexure mode. These wall thickening portions also enhance the flow characteristics of the molten plastic during injection molding manufacture by serving as flow leaders.

The specific nature of the present invention, and the foregoing as well as other objects, features and advantages, will become readily apparent to those of ordinary skill in the art from the following detailed description of the best mode presently known to the inventor of making and using the invention, taken in conjunction with the appended claims and accompanying drawings (which are to engineering scale unless other indicated) wherein, by way example only, a preferred embodiment of the present invention is illustrated.

DETAILED DESCRIPTION OF THE PREFERRED EMBODIMENT OF THE INVENTION

Figure 1:
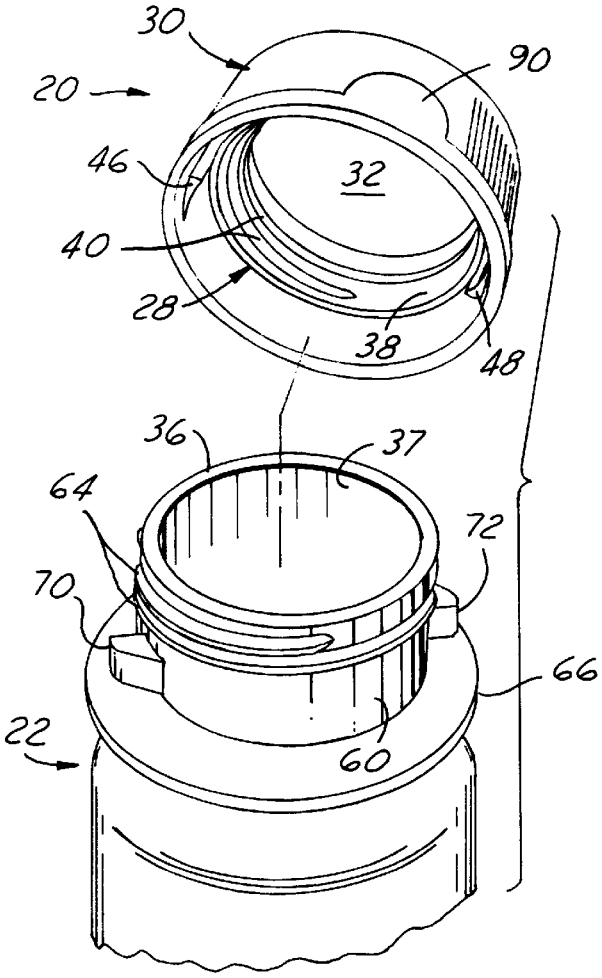
FIG. 1 is a perspective, exploded, elevational view of the dispensing end of a container and a child-resistant safety closure embodying one preferred version of the present invention.

In accordance with one preferred embodiment of the present invention exemplified in FIG. 1, a molded plastic safety closure 20 is perspectively illustrated in disassembled overlying relationship with an associated molded plastic container generally designated at 22 of which only the dispensing end 24 is shown. Closure 20 is designed to be threadably assembled on container dispensing end 24 and threadably advanced downwardly thereof to a fully closed position depicted in FIG. 2. When thus assembled, safety closure 20 is designed to interlock with container dispensing end 24 and resist retrogressive threaded closure-turning movements necessary for normal threaded removal of the closure from the container.

As illustrated, safety closure 20, which is preferably injection mold fabricated as a unitary member from a resilient plastic, such as polyvinyl chloride, polypropylene, or similar resilient or pliant material, has a generally cup-shaped overall configuration as defined by a closed upper end base wall 26 carrying depending, integral, concentric inner and outer annular sidewalls 28 and 30 that respectively form the inner and outer peripheral skirts typical of a double wall squeeze-and-turn safety closure. A sealing liner 32 (FIGS. 1, 2 and 7) is loosely or adhesively affixed to the underside surface 34 of base wall 26 and is adapted to normally seal against the upper edge 36 of the dispensing opening 37 of container dispenser end 24 in fluid-tight sealed relationship when closure 20 is assembled on container 22 in the fully closed position shown in FIG. 2. Alternatively, closure 20 may incorporate a conventional linerless sealing system (i.e. a valve seal, a plug seal, a V-seal or a combination of such sealing systems).

Figure 7:
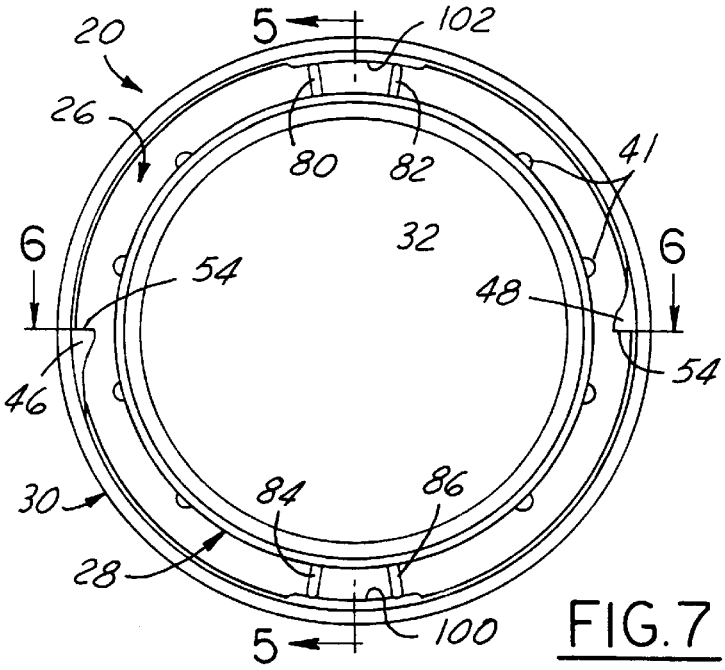
FIG. 7 is a bottom plan view of the closure shown by itself.

Inner skirt 28 has a threaded section on its interiorly facing surface 38 in the form of a continuous female buttress thread 40 operable for a threadable engagement of closure 20 on dispensing end 24 of the container. Inner skirt 28 preferably is provided on its outer periphery with eight axially extending integral ribs 41 spaced angularly at equal increments as shown in FIG. 7 which serve as unscrewing lugs to facilitate removal of the closure from the mold in which it is fabricated, and which also serve to reinforce the skirt against outward flaring stresses. Ribs 41 also serve as flow leaders to enhance mold filling of the major thin wall sections of skirt 28, thereby enabling additional overall weight savings to be achieved in closure 20.

Outer skirt 30 has a general configuration that is slightly frusto-conical and is of flexible and resiliently deformable construction. Also, as illustrated, outer skirt 30 extends axially downwardly beyond the depending free end 29 of inner skirt 28 and terminates in a distal free end portion defined by a thickened, circular, circumferentially continuous band 42, and is adapted to cooperatively interlock with the container dispensing end 24 in its final threadably assembled position. For this purpose, the interior surface 44 of skirt 30 is provided with a diametrically opposite and axially extending locking CR lugs 46 and 48 integrally formed thereon and which project radially inwardly into the interior annular space between the inner and outer skirts 28 and 30.

Figure 2:
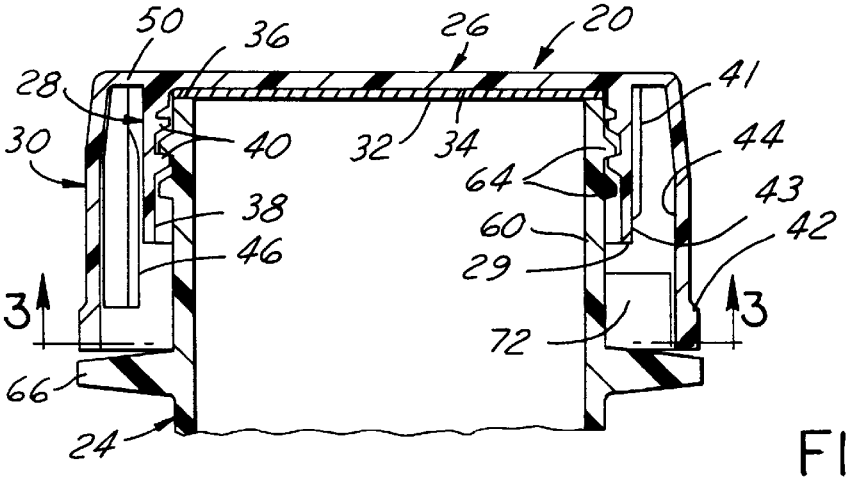
FIGS. 2 and 3 are sectional views taken respectively along the section lines 2—2 and 3—3 of FIGS. 2 and 3 with the closure shown in fully closed and interlocked child-resistant engagement with the dispensing end of the container.
Figure 6:
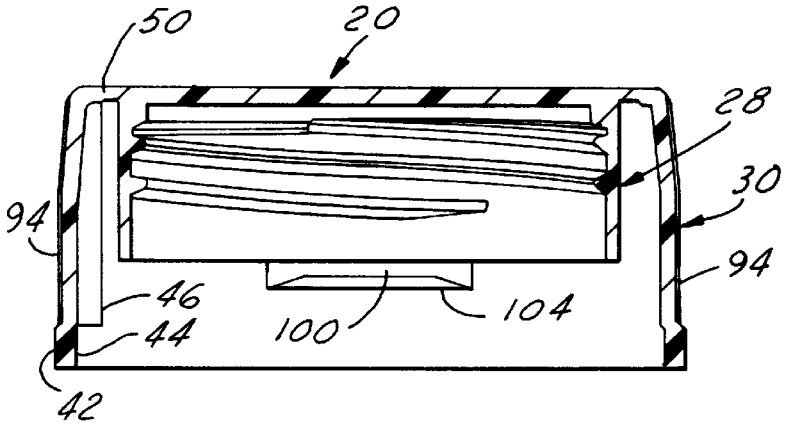

Locking lugs 46 and 48 extend axially of skirt 30 essentially its entire interior length and their upper ends integrally adjoin the underside surface of an annular peripheral portion 50 of base wall 26 disposed radially between the upper ends of inner and outer skirts 28 and 30 (FIGS. 2 and 6). The axially opposite, lower end of each lug 46, 48 terminates at a location proximately recessed upwardly from band 42 within the interior confines of outer skirt 30. Thus, locking lugs 46 and 48 are secluded within the closure, and when the closure is assembled on the dispensing end of the container, the locking lugs are inaccessible and unobservable.

Figure 8:
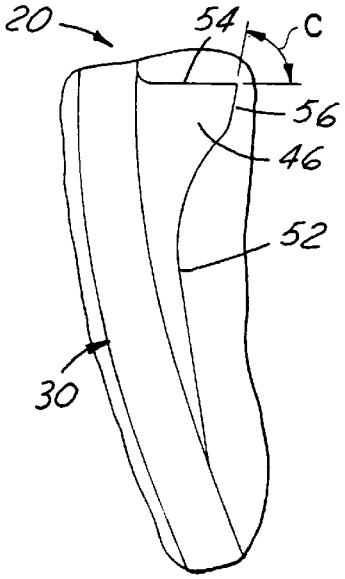
FIG. 8 is a greatly enlarged fragmentary plan view of the left-hand closure engagement lug as shown in FIG. 7.

As shown in the enlarged view of FIG. 8, each locking lug 46, 48 has a leading edge camming surface 52 configured in radial cross section as shown to scale in FIG. 8, and a substantially radially and axially extending locking ledge abutment surface 54. Camming surface 52 preferably has a parabolic contour as shown in FIG. 8 that terminates in a planar ramp portion 56 oriented in a plane intersecting a radius of the closure at an angle C of preferably 80 degrees.

With regard to container 22, dispensing end 24 thereof includes a finish in the form of an exteriorly threaded neck portion 60 terminating at its upper end in annular rim 36 which in turn defines the dispensing opening 37 communicating with the interior confines of the container. A continuous integral male buttress thread 64 is provided on the exterior of neck 60 that is designed for complementary threadable engagement with female thread 40 on inner skirt 28 of the closure.

Figure 3:
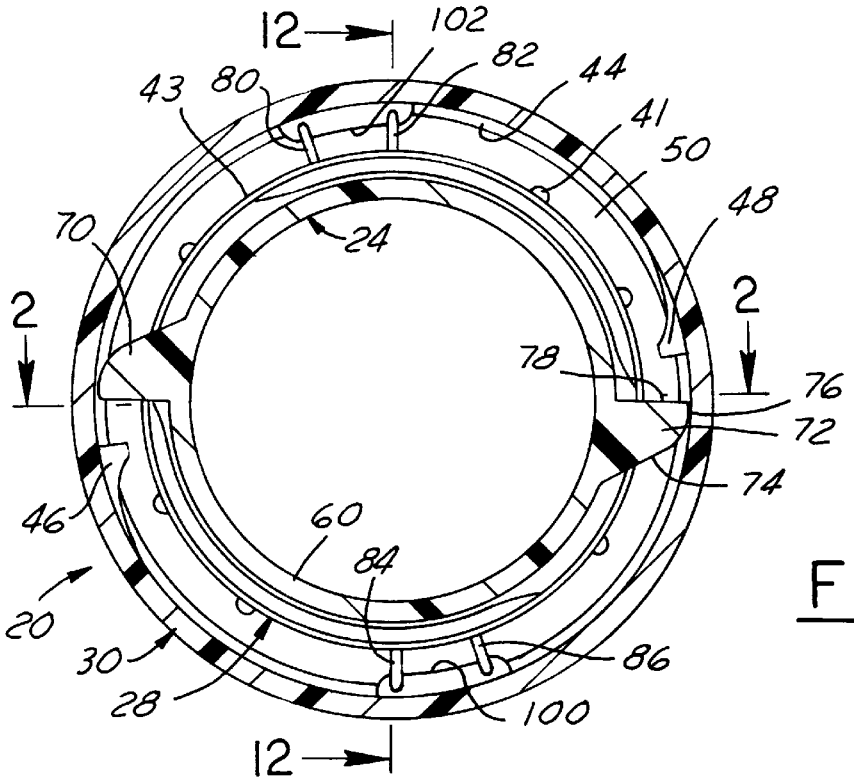

The container finish is also provided a circumferentially continuous radially outwardly protruding external flange 66 having a slightly, outwardly convergent tapering radial cross section and an outside diameter generally the same as that of closure band 42. Flange 66 may be formed as shown, i.e., as a discrete annular protuberance extending radially outwardly from container dispensing end 24 in the form of an external flange, or alternatively may be formed as a shoulder (not shown) on the upper end of dispensing end 24 to thereby allow container sidewall continuity. A pair of diametrically opposite, radially protruding CR locking lugs are formed integrally with both the upper surface of flange 66 and the outer surface of neck 60 and have a configuration in radial section as best seen in FIG. 3 (and also shown in FIGS. 9–11). Each finish locking lug 70, 72 thus has a leading face camming surface 74 (FIG. 3) inclined at about 45 degrees to an intersecting radius of the neck and in the direction opposite to rotation of the cap and closure in the screw-down or tightening threading direction. The outer free end of each lug is rounded to a circumferentially extending nose surface 76 that terminates at a radially and axially extending locking abutment surface 78. The abutment surfaces 78 of finish lugs 70 and 72 are oriented by design to respectively abut against one each of the associated abutment surface 54 of closure locking lugs 46 and 48 when closure 20 is threadably advanced to a fully closed position, such as is indicated in FIGS. 2 and 3. In this position, the sealing liner 32 is designed to tightly seal the dispensing opening 62 by seating against and forming a fluid-tight seal with the annular rim seat 36.

Figure 9:
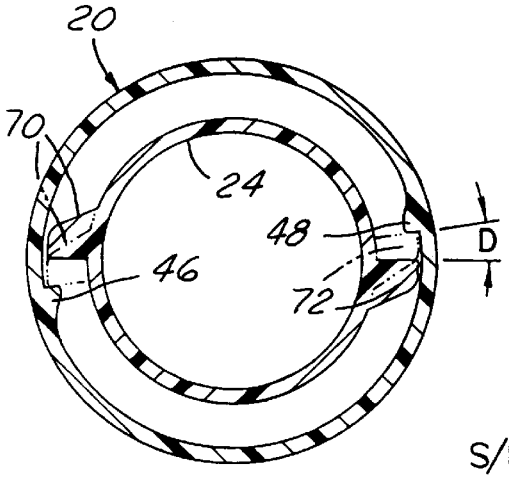
FIGS. 9, 10 and 11 are simplified diagrammatic views illustrating the squeeze-and-turn ovalization unlocking sequence employed in operating the closure to effect its removal.

By virtue of the particular construction described above, during the course of threaded attachment or screw-on turn-down advancement of the safety closure 20 on container dispensing end 24, closure CR lugs 46 and 48 will, prior to reaching their fully closed position, engage via their camming surfaces 52/56, the inclined camming surfaces 74/76 of the associated finish CR lugs 70 and 72. Thereafter, further threaded advancement of the closure will cause the closure CR lugs 46 and 48 to be cammingly displaced radially outwardly as permitted by the outward flexing movement of outer skirt 30 as the same deforms or distends sufficiently to accommodate this continued manual thread advancement of the closure to the fully closed position shown in FIGS. 2 and 3, in which, as previously described, liner 32 is pressed into sealing contact with rim surface 36. As indicated in FIG. 9, this condition preferably occurs within a tolerance angle D of rotation of lugs 70 and 72 past their final cam-over travel engagement with the associated closure lugs 46 and 48. Angle D may be on the order of 10 degrees. Abutment surfaces 78 of finish lugs 70 and 72 are then disposed to provide an abutment locking with abutment surfaces 54 of each of the associated closure locking CR lugs 46 and 48 to thereby prevent any attempted reverse, or retrogressive, threaded unscrewing turning movement necessary for removal of closure 20 from container 22. Thus, normal threaded removal of safety closure 20, such as may be attempted by an unknowledgeable child, is resisted.

Figure 10:
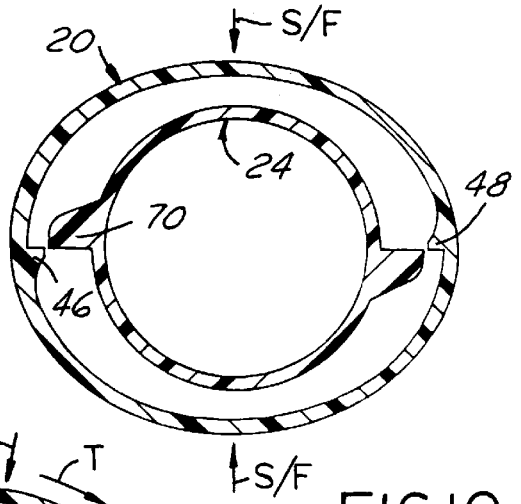
Figure 11:
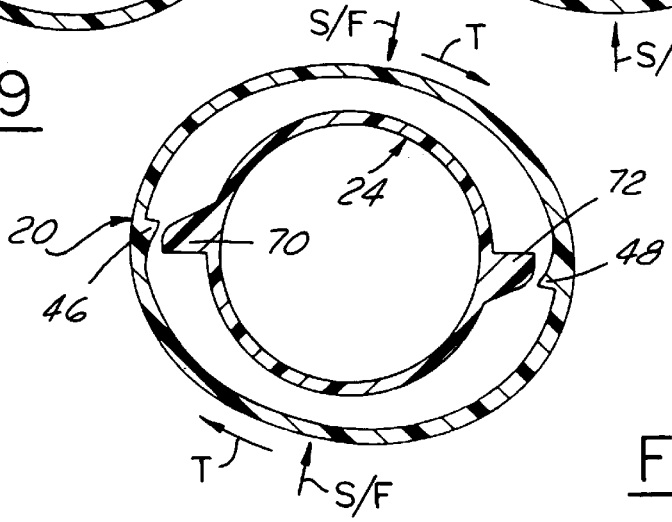

However, removal of safety closure 20 from container 22 may be accomplished by a mature or knowledgeable person in a relatively facile but more sophisticated manner by generally following the conventional closure removal procedure employed with prior double wall squeeze-and-turn safety closures, as indicated diagrammatically in sequence in FIGS. 9, 10 and 11. First the closure outer skirt CR lugs 46 and 48 must be disengaged from their interlocking engagement condition, shown in FIG. 9, with the finish CR lugs 70 and 72. This is accomplished by following the closure opening sequence labeling shown in FIG. 4, namely, "Squeeze Sides & Turn To Open".

Thus, manually compressing the resiliently deformable distal end portion of closure outer sidewall or skirt 30 at closure "squeeze" locations circumferentially straddling the interlocking CR lug engagement zones will yieldably deform or distend resiliently flexible outer skirt 30 from its normal generally circular cross sectional configuration (shown in FIGS. 2, 3 and 9) to a generally elliptical cross sectional configuration depicted in FIGS. 10 and 11. This manually applied squeeze force is indicated diagrammatically by the opposed arrows S/F in FIGS. 10 and 11. Such manual compression is then coupled with concurrently applied retrogressive rotational torque on closure 20 (indicated by directional torque arrows T in FIG. 11). This squeeze-and-turn manipulation thus causes the abutment surfaces 54 of closure skirt CR lugs 46 and 48 to be displaced radially outwardly to clear abutment surfaces 78 of the finish lugs 70 and 72, as depicted in FIGS. 10 and 11, and then allows closure lugs 46, 48 to override finish lugs 70, 72 as further retrogressive or unscrewing rotation of the closure is thereby effected.

In the illustrated embodiment, it is to be understood that the axial height from the lower end of CR lugs 46 and 48 is designed, relative to the axial height of the upper edge of the finish lugs 70 and 72 and relative to the pitch of the threads 40 and 64, such that when closure 20 has been retrogressively unscrewed or rotated one-half turn (180°) from its fully closed position, the lugs will be axially displaced to clear one another so that further normal threaded removal of the closure is not blocked. However, if desired, a second safety interlocking action can be provided in the manner of the aforementioned '945 patent by suitable design of the aforementioned locking lug heights and thread pitch.

Except for the improved configuration of the camming contours of the closure skirt CR lugs 46, 48 and their associated finish CR lugs 70 and 72, it will be seen from the foregoing that the general construction and operation of closure 20 is similar to that of the corresponding safety closure of the aforementioned '945 patent.

Figure 12:
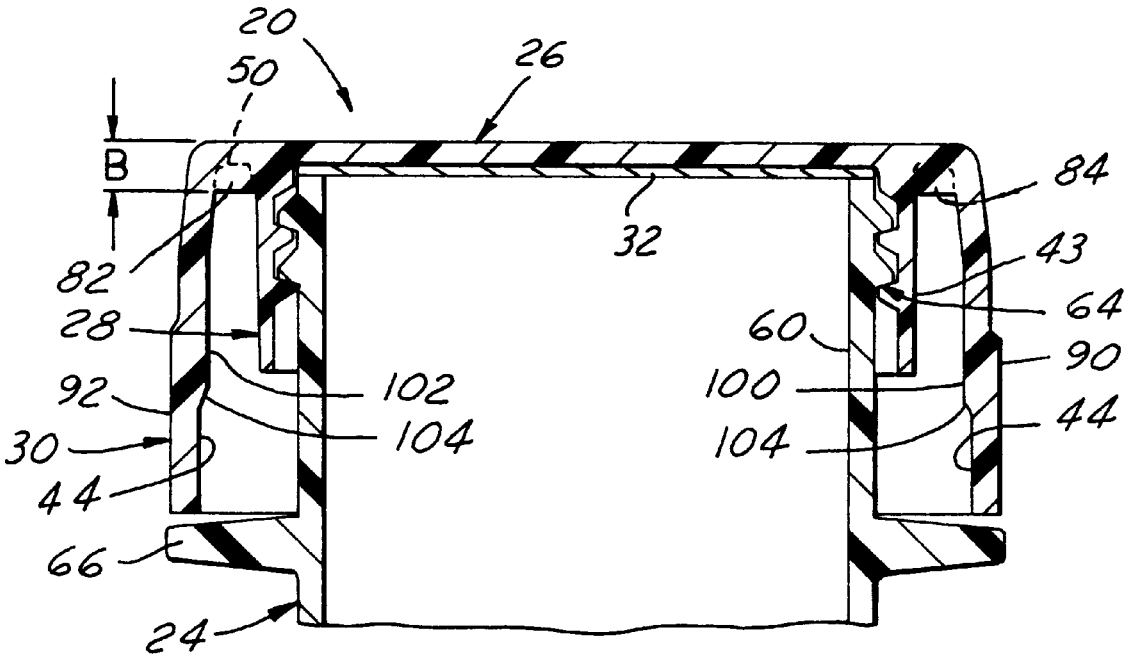
FIG. 12 is a sectional view taken along the section line 12—12 in FIG. 3.

However, as best seen in FIGS. 3, 5, 7 and 12, in accordance with one of the principal improvement features of the present invention, it is to be noted that closure 20 is provided with two diametrically opposed pairs of stiffening webs 80, 82 and 84, 86, each of which extends radially between and is integrally connected at respective axially opposite ends to the inner and outer skirts 28 and 30. Preferably, as best seen in FIG. 7, each associated web pair 80/82 and 84/86 is angularly located so as to be circumferentially spaced 10° from either side of an imaginary diametrical plane (i.e., section line 5—5) extending perpendicular to an imaginary diametrical plane (i.e., section line 6—6) intersecting the abutment faces 54 of outer skirt locking lugs 46 and 48. As best seen in FIG. 12, each of the webs 82–86, in addition to being integrally joined at its radially outer edge to outer skirt 30 and integrally joined at its radially inner edge to inner skirt 20, is integrally joined at its upper edge to the base wall peripheral portion 50 of closure base wall 26. As also indicated in FIG. 12, the lower edge of each web 82–86 is located at a predetermined dimensional distance "B" from the plane of the outer surface of closure base wall 26. Note that the corresponding axial dimension of portion 50 of base wall 20 is the dimensional distance "A" shown in FIG. 5.

Figure 4:
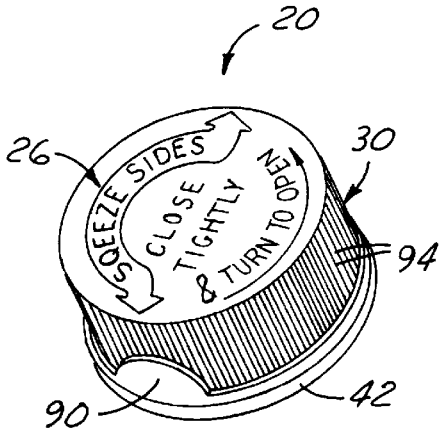
FIG. 4 is a perspective view of the exterior side of the safety closure shown by itself.
Figure 5:
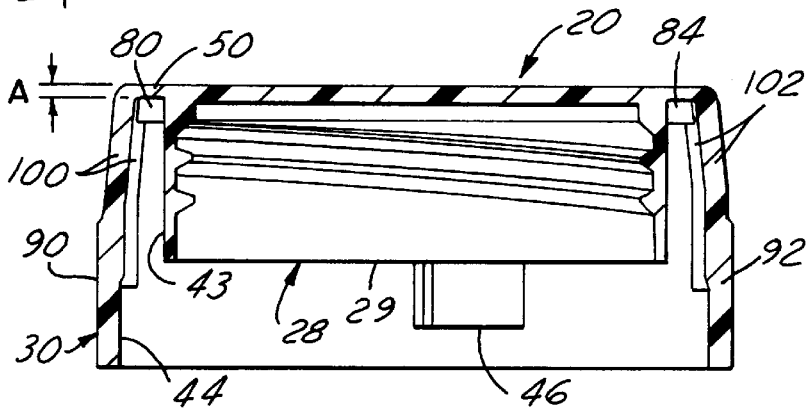
FIGS. 5 and 6 are sectional views taken respectively along the section lines 5—5 and 6—6 of FIG. 7 illustrating the closure by itself.

In accordance with another improvement feature of the present invention, and as best seen in FIGS. 1 and 4, the exterior surface of outer skirt 30 of closure 20 is provided with a pair of diametrically oppositely located finger squeeze pads 90 and 92 respectively angularly aligned with rib pairs 80, 82 and 84, 86, but located axially offset downwardly therefrom so as to be contiguous with and form an upward extension of the peripheral band 42 at the distal free end of outer skirt 30. Pads 90 and 92 are semicircular in configuration as viewed in elevation and as seen in perspective in FIGS. 1 and 4. As best seen in FIGS. 5 and 12, outer skirt 30 is thus radially thickened in the circumferential zones occupied pressure pads 90 and 92, i.e., compare the greater cross sectional thickness through pads 90 and 92 shown in FIG. 5 with the lesser cross sectional thickness through remaining circumferential extent of the wall of skirt 30 as shown in the radial cross section of FIG. 6. Preferably, and as best seen in FIGS. 4 and 6, the outer periphery of thin-walled major portion of skirt 30 above skirt band 42 and outside of pads 90 and 92 is provided with very fine, axially extending serrations 94 to enhance the frictional finger grip for applying turning force to the closure.

In accordance with a further improvement feature of the invention, and as best seen in FIGS. 5, 6 and 12, the interior surface 44 of outer skirt 30 is provided with a pair of radially thickened flow leader wall portions in the form of radially inwardly protruding stiffening sections 100 and 102, each having its lower edge 104 located axially at an elevation between the lower edge of closure CR lugs 46, 48 and lower edge 29 of inner skirt 28 (FIGS. 6 and 12). Sections 100 and 102 merge integrally at their upper ends into the base wall peripheral portion 50. As best seen in FIG. 12, the lower edge 104 of each thickening portion 100 and 102 is located about mid-way in the axial height of the associated finger pad 90, 92. Hence the wall thickening of skirt 30 provided by squeeze pads 90 and 92 is in essence continued axially upwardly to the skirt squeeze zones by means of the inner wall thickening protuberances 100 and 102 formed in the inner surface 44 of skirt 30. Likewise, as shown in FIGS. 3 and 7, the reinforcing protuberances 100 and 102 are angularly registered with and extend circumferentially between and a short distance beyond each associated pair of stiffening webs 80, 82 and 84, 86.

In the operation of squeeze-and-turn manipulation release of locking engagement of closure 20 on container 22, as modified in accordance with the foregoing improvement features, it will be seen that the stiffening webs 80–86 shorten the force arm or effective moment arm of the squeeze zone of the wall of outer skirt 30, i.e., the area of squeeze pads 90 and 92, by an amount equal to the height of webs 80–86, i.e., the difference between dimension A of FIG. 5 and dimension B of FIG. 12, for example a distance of 0.078 inches in the illustrated exemplary embodiment of scaled drawings FIGS. 5, 6 and 12. Webs 80–86 thereby effectively move the living hinge swing point of outer skirt 30 when squeeze deflected by finger pressure on pads 90 and 92 from its prior locus at the inside top of inner skirt 28 (absent webs 80–86) to the lowermost attachment point of the webs to outer skirt 30. This shortening of the force arm caused by the provision of the stiffening webs 80–86 thus requires a greater squeeze force, relative to the thickness of the wall of skirt 30, to be applied to pads 90 and 92 in order to displace the CR lugs 46 and 48 sufficiently to produce the requisite outer skirt ovalization deformation required to rotationally unlock the closure CR lugs 46 and 48 from the restraint of the finish CR lugs 70 and 72. The provision of these stiffening webs 80–86 extending between the inner and outer skirts 28 and 30 also requires the application of such squeeze force to be more localized, i.e., applied directly on the squeeze pads 90 and 92, in order to generate sufficient ovalization for locking lug disengagement. Moreover, this stiffening action of the connecting webs 80–86 is enhanced by and cooperates with the localized thickening of the wall of skirt 30 provided by pressure pads 90 and 92 and the associated interior wall protuberances 100 and 102 that are angularly and axially aligned therewith. These squeeze zone stiffening features thus cooperate to make more difficult accidental opening of the closure when the upper reaches of the outer skirt 30 of the closure are bitten by a child placing the closure between its teeth and applying bite pressure.

Due to the provision of the stiffening webs 80–86, either alone or in conjunction with the wall thickening provided by the pads 90, 92 and protuberances 100, 102, the wall thickness in the remainder of outer skirt 30, as well as in the portion 50 of the base wall 26, can be substantially thinned over prior designs, thereby substantially reducing the overall weight (and material cost) of closure 20 without a corresponding reduction in the squeeze force required to de-activate the closure's CR feature.

In addition, the simple addition of the stiffening webs 80–86 reduces the usual vertical travel of the outer skirt 30 that occurs during squeezing to produce ovalization by shifting the living hinge swing fulcrum point as described previously. Thus, when squeezed, the required radially outward standoff of the squeeze portion of the wall is effectively reduced. This in turn allows for reduced radial design clearance between skirt 30 and the container finish, thereby inhibiting the ability of children to gain purchase under the closure with their teeth and also improving aesthetics from the design standpoint by decreasing the requisite overall diametrical dimension of the closure.

It also will now be understood from the foregoing disclosure by those skilled in the art that one or more webs 80–86 can be used in closure 20 to create the desired effect of localizing application of force while enabling thinning of wall thickness and reduction in overall weight. Also, the height and shape of the webs can be varied to suit the size of the closure as well as to design manage the forces and wall thicknesses desired in the particular closure design. For example, triangular or arch gusset formations may be utilized, if desired, in the form and shape of webs 80–86.

From the foregoing description, it also will be apparent that the improved double wall squeeze-and-turn safety closure of the invention amply fulfills the aforestated objects and provides many advantages over the prior art. Closure 20 is highly functional and manufacturable, and will pass current senior/child protocol testing despite outer skirt (and base wall periphery) wall thinning to thereby reduce the amount of closure material required, and thus reduce overall cost to the closure manufacturers as well as to their customers. The stiffening webs, either alone or in conjunction with the localized thickening of the pressure zone of the outer skirt wall, by enabling the remainder of the skirt wall to be made thinner than usual, also provides a reduction in overall weight in a double wall squeeze-and-turn closure while still maintaining the stiffness necessary to pass child protocol regulations. Moreover, the stiffening webs effectively reduce the force application area available to de-activate the closure's CR lug engagement, thereby further enhancing the child resistant characteristics of the closure.

The webs thus can be varied as to their number, contour, thickness, axial extent and other structural parameters, as will be apparent to those of ordinary skill in the art from the foregoing disclosure, in order to control by design the location and amount of compression and expansion of outer skirt 30 in selected areas of closure 20. Hence, design flexibility is enhanced which in turn can be used to advantage in enhancing marketability of the closure and container combination from the standpoint of both function and appearance.

I claim:

1. A squeeze and turn plastic closure comprising (a) a base wall, (b) an outer peripheral skirt wall joined at one axial end to said base wall and having diametrically opposed squeeze pressure application zones, (c) an inner peripheral skirt wall also joined at one axial end to said base wall and concentrically spaced radially inwardly of said outer wall, (d) integral thread means on an inner surface of said inner wall adapted for engaging thread means on a finish of a associated container, (e) a set of diametrically opposed CR lugs on said outer wall of said closure adapted for engaging cooperative CR lugs on the finish of the container and being angularly offset from said outer wall squeeze zones, and (f) skirt flexure stiffening integral web means extending between an inner surface of said outer wall and an outer surface of said inner wall, said web means being angularly offset and positioned circumferentially spaced apart from and generally between said outer wall CR lugs and generally angularly aligned with at least one of said outer wall squeeze zones.

2. The closure set forth in claim 1 wherein said web means comprises a set of diametrically opposed web means extending between the inner surface of said outer wall and the outer surface of said inner wall and each respectively generally angularly aligned with an associated one of said outer wall squeeze zones.

3. The closure set forth in claim 2 wherein said diametrically opposed set of web means are angularly oriented at about 90 degrees with respect to said closure CR lugs.

4. The closure set forth in claim 2 wherein each said web means of said set comprises radially extending ribs integrally joined to said skirt walls and said base wall and protruding axially of said closure in a direction away from said skirt wall axial ends a predetermined distance greater than an axial thickness of said base wall at least in a peripheral region thereof joined to said skirt walls.

5. The closure set forth in claim 4 wherein each said web means of said set comprises a pair of said radially extending ribs angularly spaced apart from one another on said base wall and disposed closely adjacent to and on either side of a plane oriented at about 90 degrees to a plane intersecting said closure CR lugs.

6. The closure set forth in claim 5 wherein said outer wall has a pair of pressure pads located one in each of said squeeze zones and forming a radially thickened portion of said outer skirt wall.

7. The closure set forth in claim 6 wherein said outer wall has wall thickening portions radially inwardly protruding from the inner surface thereof and generally angularly aligned with said pressure pads and said set of web means.

8. In a child-resistant safety closure adapted for threadable attachment on a container having a generally cylindrical hollow dispensing end finish including an exteriorly threaded neck portion, an annular rim defining a dispensing opening, and a CR lug orientationally arranged to interlock said closure on said dispensing end when said closure is threadably advanced to a fully closed position on said neck portion, said closure comprising:

a closed base endwall provided with sealing means on an underside surface thereof arranged to seal said dispensing opening in fluid-tight sealed relationship, annular inner and outer skirt sidewalls depending integrally from said closed endwall in radially interspaced relationship, said outer sidewall having a distal end portion projecting axially beyond said inner sidewall and defining a generally circular cross-sectional configuration, said distal end portion being sufficiently flexible to deform from said generally circular cross-sectional configuration to a generally elliptical cross-sectional configuration in response to manual compression of diametrically opposite sides thereof and being sufficiently resilient to essentially resume said generally circular cross-sectional configuration promptly upon release of said manual compression, said inner sidewall defining a threaded interior surface portion threadably engageable with the threaded neck portion of said container to accommodate threaded advancement of said closure on said neck portion to said fully closed position in which said sealing means is adapted to assume fluid-tight sealing relationship with said dispensing opening, a pair of CR lugs integrally formed on the outer sidewall of said closure and adapted to override interlocking engagement with the CR lug on said container in response to normal threaded advancement of said closure on said neck portion, but to intercept the CR lug in interlocking engagement in response to normal threaded retrogressive movement of said closure on said neck portion, and said interlocking engagement being releasable in response to manual compression and concurrent threaded retrogressive movement applied to said outer sidewall of said closure, whereby manual compression coupled with concurrent threaded retrogressive movement customarily must be premeditatively applied to said outer sidewall of said closure at periphery squeeze zone locations straddling the interlocking locations in order to threadably remove said closure from said neck portion;

the improvement in combination therewith of integral skirt flexure stiffening web means extending between an inner surface of said outer sidewall and an outer surface of said inner sidewall, said web means being angularly offset and positioned circumferentially spaced apart from and generally between said closure CR lugs and generally angularly aligned with at least one of said outer sidewall squeeze zones.

9. The closure set forth in claim 8 wherein said web means comprises a set of diametrically opposed web means extending between the inner surface of said outer sidewall and the outer surface of said inner sidewall and each respectively generally angularly aligned with an associated one of said outer wall squeeze zones.

10. The closure set forth in claim 9 wherein said diametrically opposed web means of said set are angularly oriented at about 90 degrees with respect to said closure CR lugs.

11. The closure set forth in claim 9 wherein each said web means of said set comprises radially extending ribs integrally joined to said skirt sidewalls and said base endwall and protruding axially of said closure in a direction away from said base endwall a predetermined distance greater than an axial thickness of said base endwall at least in a peripheral region thereof joined to said skirt sidewalls.

12. The closure set forth in claim 11 wherein each said web means of said set comprises a pair of said radially extending ribs angularly spaced apart from one another on said base endwall and disposed closely adjacent to and on either side of a plane oriented at about 90 degrees to a plane intersecting said closure CR lugs.

13. The closure set forth in claim 12 wherein said outer sidewall has a pair of pressure pads located one in each of said squeeze zones and forming a radially thickened portion of said outer skirt sidewall.

14. The closure set forth in claim 13 wherein said outer wall has wall thickening portions radially inwardly protruding from the inner surface thereof and generally angularly aligned with said pressure pads and said set of web means.

15. In a child-resistant safety closure and container combination comprising:

a container having a generally cylindrical hollow dispensing end including an exteriorly threaded neck portion and an annular rim defining a dispensing opening;

a closure for said container having a closed end base wall provided with sealing means on an underside surface thereof arranged to seal said dispensing opening in fluid-tight sealed relationship, and concentric annular depending inner and outer skirt sidewalls arranged in radially interspaced relationship, said outer sidewall having a distal end portion projecting axially beyond said inner sidewall and defining a generally circular cross-sectional configuration, said distal end portion being sufficiently flexible to deform from said generally circular cross-sectional configuration to a generally elliptical cross-sectional configuration in response to manual compression of squeeze zones on diametrically opposite sides thereof and being sufficiently resilient to essentially resume said generally circular cross-sectional configuration promptly upon release of said manual compression, said inner sidewall defining a threaded interior surface portion threadably engageable with the threaded neck portion of said container to accommodate threaded advancement of said closure on said neck portion to a fully closed position in which said sealing means assumes fluid-tight sealing relation with said dispensing opening;

cooperative interlocking means including CR lugs integrally formed on the distal end portion of said closure and on the dispensing end of said container, said CR lugs being arranged to override interlocking engagement with each other in response to normal threaded advancement of said closure on said neck portion and to intercept each other in interlocking engagement in response to normal threaded retrogressive movement of said closure on said neck portion, and said interlocking engagement being releasable in response to manual compression and concurrent threaded retrogressive movement applied to the outer sidewall of said closure at peripheral locations of the squeeze zones straddling said interlocking engagement; whereby manual compression coupled with concurrent threaded retrogressive movement customarily must be premeditatively applied to the distal end portion of said closure at the peripheral squeeze zone locations straddling interlocking locations in order to threadably remove said closure from said neck portion; and skirt flexure stiffening integral web means extending between an inner surface of said outer sidewall and an outer surface of said inner sidewall, said web means being angularly offset and positioned circumferentially spaced apart from and generally between said closure CR lugs and generally angularly aligned with at least one of said outer wall squeeze zones.

16. The combination set forth in claim 15 wherein said web means comprises a set of diametrically opposed web means extending between the inner surface of said outer sidewall and the outer surface of said inner sidewall and each respectively generally angularly aligned with an associated one of said outer wall squeeze zones.

17. The combination set forth in claim 16 wherein said diametrically opposed web means of said set are angularly oriented at about 90 degrees with respect to said closure CR lugs.

18. The combination set forth in claim 16 wherein each said web means of said set comprises radially extending ribs integrally joined to said skirt sidewalls and said base wall and protruding axially of said closure in a direction away from said base wall a predetermined distance greater than an axial thickness of said base wall at least in a peripheral region thereof joined to said skirt sidewalls.

19. The combination set forth in claim 18 wherein each said web means of said set comprises a pair of said radially extending ribs angularly spaced apart from one another on said base wall and disposed closely adjacent to and on either side of a plane oriented at about 90 degrees to a plane intersecting said closure CR lugs.

20. The combination set forth in claim 18 wherein said outer sidewall has a pair of pressure pads located one in each of said squeeze zones and forming a radially thickened portion of said outer skirt sidewall.

21. The combination set forth in claim 20 wherein said outer sidewall has wall thickening portions radially inwardly protruding from the inner surface thereof and generally angularly aligned with said pressure pads and said set of web means.

22. A method of constructing a squeeze and turn plastic closure of the type having (a) a base wall, (b) an outer peripheral skirt wall joined at one axial end to said base wall and having diametrically opposed squeeze pressure application zones, (c) an inner peripheral skirt wall also joined at one axial end to said base wall and concentrically spaced radially inwardly of said outer wall, (d) integral thread means on an inner surface of said inner wall adapted for engaging thread means on a finish of a container, (e) a set of diametrically opposed CR lugs on said outer wall adapted for engaging cooperative CR lugs on the finish of the container and being angularly offset from said outer wall squeeze zones, and wherein said method comprises the steps of:

(1) providing skirt flexure stiffening integral web means extending between an inner surface of said outer wall and an outer surface of said inner wall, and (2) orienting said web means so that said web means is angularly offset and positioned circumferentially spaced apart from and generally between said outer wall CR lugs and generally angularly aligned with at least one of said outer wall squeeze zones.

* * * * *